United States Patent [19]

Pedigo

[11] Patent Number: 4,993,963

[45] Date of Patent: Feb. 19, 1991

[54] PROTECTIVE COVER FOR ELECTRIC SOCKETS

[76] Inventor: William S. Pedigo, 15158 Sheffield Terrace, Channelview, Tex. 77530

[21] Appl. No.: 434,976

[22] Filed: Nov. 9, 1989

[51] Int. Cl.[5] ..... H01R 13/44

[52] U.S. Cl. ..... 439/142; 174/67; 220/242

[58] Field of Search ..... 439/135, 136, 142, 144, 439/147, 367, 373; 174/67; 220/242, 324

[56] References Cited

U.S. PATENT DOCUMENTS

| | | | |
|---|---|---|---|
| 2,439,708 | 4/1948 | Abraham | 200/50 A |
| 2,510,745 | 6/1950 | Kilgore | 174/48 |
| 2,722,665 | 11/1955 | Sauder | 439/135 |
| 2,942,226 | 6/1960 | Low | 174/67 |
| 3,499,102 | 3/1970 | Gillemot et al. | 439/135 |
| 3,781,495 | 12/1973 | Splingaerd | 200/61.19 |
| 4,015,868 | 4/1977 | Buttler | 292/302 |
| 4,083,618 | 4/1978 | Busch, Jr. | 174/67 |
| 4,109,095 | 8/1978 | Kling | 174/67 |
| 4,586,765 | 5/1986 | Ban | 439/142 |
| 4,603,931 | 8/1986 | Ruffman | 439/144 |
| 4,603,932 | 8/1986 | Heyerliey | 439/142 |
| 4,618,200 | 10/1986 | Roberts et al. | 439/367 |
| 4,630,750 | 12/1986 | Hughes | 220/324 |
| 4,749,363 | 6/1988 | Luska et al. | 439/367 |
| 4,915,638 | 4/1990 | Domian | 439/142 |

*Primary Examiner*—Neil Abrams
*Attorney, Agent, or Firm*—Neal J. Mosely

[57] ABSTRACT

A protective cover for electric sockets consists of a base plate having openings to fit the individual electric receptacles and an opening to receive the mounting screw to secure the base plate in place of the usual socket cover plate. A box-shaped cover is hingedly connected on one side of the base plate and is opened to permit installation and removal of electric plugs in said receptacles. The box-shaped cover has slots extending along the side and top thereof through which the cords may extend from the plugs secured in said electric receptacles. The base plate and box-shaped cover have matching fasteners to secure the cover against being easily opened by a child. The hinged connection of the cover to the base plate may be separate hinge members pivotally secured together or may be a one-piece flexible hinge of the type known as a "living" hinge.

9 Claims, 1 Drawing Sheet

PROTECTIVE COVER FOR ELECTRIC SOCKETS

FIELD OF THE INVENTION

This invention relates generally to protective covers for electric sockets and more particularly to a protective cover which is easily opened to permit installation and removal of electric plugs from the outlet and releasably locked to prevent tampering with the plug by a child.

BACKGROUND OF THE INVENTION

Safety covers and shields for electric connections and sockets are well known in the prior art. However, most such shields or covers are not easily opened for use and do not have easily opened locking devices.

Kilgore U.S. Pat. No. 2,510,745 shows a protective cover for electric outlets which snaps into place on a fixed base.

Low U.S. Pat. No. 2,942,226 shows a protective cover for appliance plugs.

Kling U.S. Pat. No. 4,109,095 shows a weatherproof protective cover for electric outlets with a pair of biased lids which are self closing around and electric cord plugged into the outlet.

Ruffman U.S. Pat. No. 4,603,931 shows a protective cover for electric outlets having an open top box secured on the outlet base with a removable cover secured in place by screws.

Heverly U.S. Pat. No. 4,609,932 shows a protective cover for electric outlets which snaps into place on a fixed base.

Roberts et al U.S. Pat. No. 4,618,200 shows a protective cover for electric outlets which snaps into place on a securing post mounted to the base of the electric outlet.

Luska U.S. Pat. No. 4,749,363 shows a protective cover for electric extension cord sockets.

This invention differs from the above-cited prior art by providing a protective cover for electric sockets which consists of a base plate having openings to fit the individual electric receptacles and an opening to receive the mounting screw to secure the base plate in place of the usual socket cover plate. A box-shaped cover is hingedly connected on one side of the base plate and is opened to permit installation and removal of electric plugs in said receptacles. The box-shaped cover has slots extending along the side and top thereof through which the cords may extend from the plugs secured in said electric receptacles. The base plate and box-shaped cover have matching fasteners to secure the cover against being easily opened by a child. The hinged connection of the cover to the base plate may be separate hinge members pivotally secured together or may be a one-piece flexible hinge of the type known as a "living" hinge.

SUMMARY OF THE INVENTION

It is therefore a general object of this invention to provide a new and improved protective cover for electric sockets.

It is another object of the present invention to provide a new and improved protective cover for electric sockets having openings for passage of electric cords from the receptacles covered by the cover.

It is another object of this invention to provide a new and improved protective cover for electric sockets which is secured on the base for the electric receptacles.

It is another object of this invention to provide a new and improved protective cover for electric sockets which is hingedly secured on the base for the electric receptacles.

It is another object of this invention to provide a new and improved protective cover for electric sockets which is hingedly secured on the base for the electric receptacles and has a locking mechanism securing the cover closed over the electric plugs and cords received in the electric socket receptacles.

It is another object of this invention to provide a new and improved protective cover for electric sockets which is hingedly secured by a two-part hinge on the base for the electric receptacles and has a locking mechanism securing the cover closed over the electric plugs and cords received in the electric socket receptacles.

It is another object of this invention to provide a new and improved protective cover for electric sockets which is hingedly secured by a "living" hinge on the base for the electric receptacles and has a locking mechanism securing the cover closed over the electric plugs and cords received in the electric socket receptacles.

It is another object of this invention to provide a new and improved protective cover for electric sockets which is hingedly secured on the base for the electric receptacles and has a sliding pin locking mechanism securing the cover closed over the electric plugs and cords received in the electric socket receptacles.

It is another object of this invention to provide new and improved protective cover for electric sockets which is hingedly secured on the base for the electric receptacles and has a sliding pin locking mechanism securing the cover closed over the electric plugs and cords received in the electric socket receptacles and having openings for passage of electric cords from the receptacles covered by the cover.

Other objects of the invention will become apparent from time to time throughout the specification and claims as hereinafter related.

The above noted and other objects of the invention are accomplished by a protective cover for electric sockets consisting of a base plate having openings to fit the individual electric receptacles and an opening to receive the mounting screw to secure the base plate in place of the usual socket cover plate. A box-shaped cover is hingedly connected on one side of the base plate and is opened to permit installation and removal of electric plugs in said receptacles. The box-shaped cover has slots extending along the side and top thereof through which the cords may extend from the plugs secured in said electric receptacles. The base plate and box-shaped cover have matching fasteners to secure the cover against being easily opened by a child. The hinged connection of the cover to the base plate may be separate hinge members pivotally secured together or may be a one-piece flexible hinge of the type known as a "living" hinge.

DESCRIPTION OF THE PREFERRED EMBODIMENT

Figure 1:
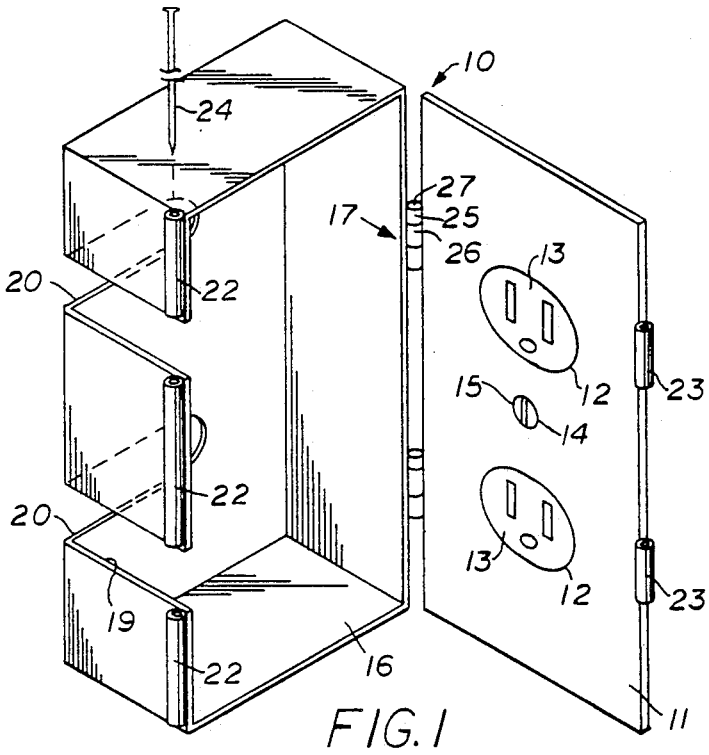
FIG. 1 is an isometric view of a protective cover for electric sockets installed in place in open position illustrating a preferred embodiment of the invention.

Referring to the drawings by numerals of reference, there is shown in FIG. 1 an isometric view of an insulated, protective cover assembly 10 for electric sockets illustrating a preferred embodiment of this invention.

Figure 4:
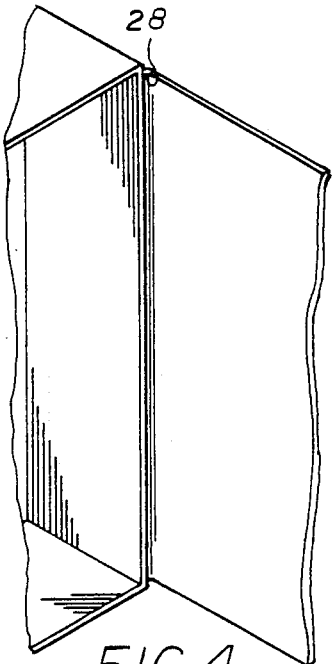
FIG. 4 is a partial, isometric view, similar to FIG. 1, of a protective cover for electric sockets installed in place in open position illustrating an alternate embodiment of the invention using a different hinge for the cover.
Figure 2:
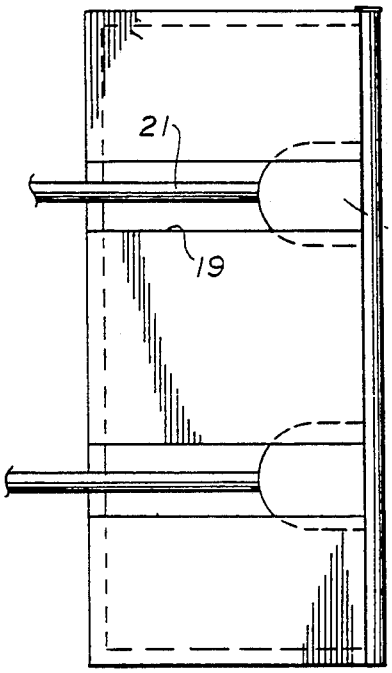
FIG. 2 is a view in side elevation of the protective cover shown in FIG. 1 in closed position.
Figure 3:
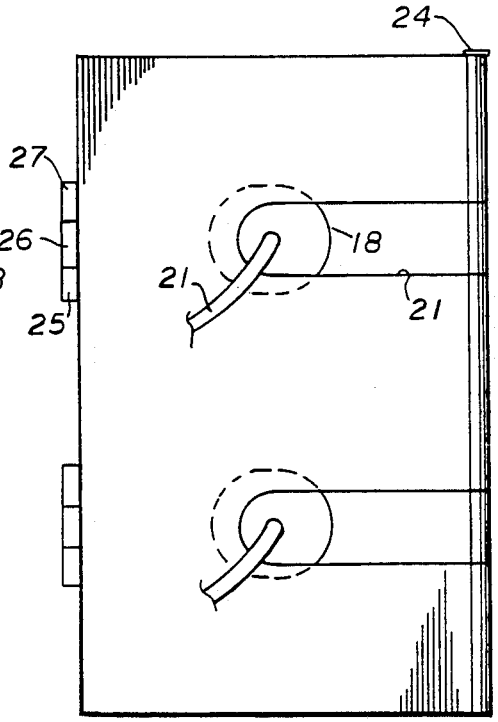
FIG. 3 is a plan view of the protective cover shown in FIG. 1 in closed position.

Protective cover assembly 10 comprises a base plate 11, of an insulating material such as plastic, hard rubber, etc., having openings 12 to fit the individual electric receptacles 13 and an opening 14 receiving the mounting screw 15 to secure the base plate in place of the usual socket cover plate. A box-shaped cover 16, of an insulating material such as plastic, hard rubber, etc., is hingedly connected, as at 17, on one side of the base plate 11 and is opened to permit installation and removal of electric plugs 18 in receptacles 13. The insulated, box-shaped cover 16 has slots 19, 20 extending along the side and top thereof through which the cords 21 may extend from the plugs 18 secured in electric receptacles 13. The insulated, base plate 11 and box-shaped cover 16 have matching fasteners 22, 23 to secure the cover 16 against being easily opened by a child. Fasteners 22, 23 are tubular, similar to a hinge, and are aligned when closed to receive a locking pin 24. The hinged connection 17 of the cover 16 to the base plate 11 may be separate hinge members 25, 26 pivotally secured together by a hinge pin 27 (FIGS. 1, 2 and 3) or may be a one-piece flexible hinge 28 of the type known as a "living" hinge (FIG. 4).

OPERATION

While the assembly and operation of this invention should be apparent from the foregoing description, a brief description of assembly and operation will be given for a clearer understanding of the invention and its function.

As previously described, the protective cover assembly 10 is preferably of electrically insulating materials such as plastic, hard rubber, etc. Cover base plate 11 is positioned on a surface in which the electric sockets are located with openings 12 positioned over electric receptacles 13. Hole 14 is positioned over the threaded mounting hole used in securing the usual cover plate in place and screw 15 inserted and tightened to secure the protective cover base plate in place.

In the view shown in FIG. 1, the box-shaped cover 16 is hinged open. Either form of hinge 17, as in FIG. 1 or FIG. 4, may be used. Electric plugs 18 are inserted in receptacles 13 and box-shaped cover 16 closed with the electric cords 21 extending from plugs 18 through the slots 19, 20 which permit free movement of the cords to the side or front of the cover assembly 10. With the cover assembly 10 closed, pin 24 is inserted in aligned locking tubes 22, 23 to secure cover 16 in a removably locked position.

While this invention has been fully and completely described, with reference to two preferred embodiments, it should be understood that, within the scope of the appended claims, the invention may be practiced otherwise than as specifically described herein.

I claim:

1. A protective cover assembly for electric sockets of the type having plug receptacles, a cover plate fitting over the receptacles, and a screw holding the cover plate thereon, comprising:

a base plate of an insulating material having openings adapted to fit said electric receptacles and an opening for receiving a mounting screw, a mounting screw adapted to fir said mounting screw opening to secure said base plate in place of said socket cover plate, a box-shaped cover of an insulating material having a front wall, top and bottom walls, and opposed side walls, hinge means on one side wall of said box-shaped cover and said base plate for hingedly supporting said box-shaped cover on one side of said base plate, said box-shaped cover being openable to permit installation and removal of electric plugs in said receptacles, said insulated, box-shaped cover having laterally spaced apart slots extending transversly along the other side wall and approximately half way across the top wall thereof through which cords may extend from plugs secured in said electric receptacles, and fastening means on said base plate and said box-shaped cover on the side opposite said hinge means for securing said box-shaped cover against being easily opened by a child.

2. A protective cover for electric sockets according to claim 1 in which said hinge means comprises separate hinge members pivotally secured together by a hinge pin.

3. A protective cover for electric sockets according to claim 1 in which said hinge means comprises a flexible portion integral with said base plate and said box-shaped cover.

4. A protective cover for electric sockets according to claim 1 in which said base plate and said box-shaped cover are each of molded or formed plastic or hard rubber.

5. A protective cover for electric sockets according to claim 1 in which said fastening means comprises tubular members on said base plate and said box-shaped cover aligned when closed, and a locking pin adapted to be inserted into said aligned tubular members for lock said box-shaped cover to said base plate.

6. A protective cover for electric sockets according to claim 1 in which said hinge means comprises separate hinge members pivotally secured together by a hinge pin, said fastening means comprises tubular members on said base plate and said box-shaped cover aligned when closed, and a locking pin adapted to be inserted into said aligned tubular members for locking said box-shaped cover to said base plate.

7. A protective cover assembly for electric sockets of the type having plug receptacles, a cover plate fitting over the receptacles, and a screw holding the cover plate thereon, comprising:

a base plate of an insulating material having openings adapted to fit said electric receptacles and an opening for receiving a mounting screw, a mounting screw adapted to fit said mounting screw opening to secure said base plate in place of said socket cover plate, a box-shaped cover of an insulating material having a front wall, top and bottom walls, and opposed side walls, hinge means comprising a flexible portion integral with said base plate and said box-shaped cover for hingedly supporting said box-shaped cover on one side of said base plate, said box-shaped cover being openable to permit installation and removal of electric plugs in said receptacles, said insulated, box-shaped cover having laterally spaced apart slots extending transversly along one of the side walls and approximately half way across the top wall thereof through which cords may extend from plugs secured in said electric receptacles, and fastening means on said base plate and said box-shaped cover on the side opposite said hinge means for securing said box-shaped cover against being easily opened by a child.

8. A protective cover for electric sockets according to claim 7 in which said fastening means comprises tubular members on said base plate and said box-shaped cover aligned when closed, and a locking pin adapted to be inserted into said aligned tubular members for locking said box-shaped cover to said base plate.

9. A protective cover for electric sockets according to claim 7 in which said base plate and said box-shaped cover are each of molded or formed plastic or hard rubber.

* * * * *